United States Patent [19]

Kajiura

[11] Patent Number: 4,831,375

[45] Date of Patent: May 16, 1989

[54] TWO-WIRE COMMUNICATION APPARATUS

[75] Inventor: Koichi Kajiura, Yokohama, Japan

[73] Assignee: Yamatake-Honeywell Co., Ltd., Tokyo, Japan

[21] Appl. No.: 168,298

[22] Filed: Mar. 15, 1988

[30] Foreign Application Priority Data

Mar. 20, 1987 [JP] Japan ..... 62-64402

[51] Int. Cl.[4] ..... G08C 19/04

[52] U.S. Cl. ..... 340/870.39; 340/870.07; 340/870.31; 340/870.16; 364/172

[58] Field of Search ..... 340/870.39, 870.07, 340/870.16, 310 A, 310 R, 870.31; 375/60, 71, 75, 76; 364/152, 172

[56] References Cited

U.S. PATENT DOCUMENTS 4,520,488 5/1985 Houvig et al. ..... 375/5
4,549,180 10/1985 Masuda ..... 340/870.39
4,607,247 8/1986 Sterling, Jr. et al. ..... 340/870.39
4,758,837 7/1988 Fruhwald ..... 340/870.39

*Primary Examiner*—John W. Caldwell, Sr.
*Assistant Examiner*—Tyrone Queen
*Attorney, Agent, or Firm*—Mitchell J. Halista; Albin Medved

[57] ABSTRACT

A communication apparatus inserted in parallel in a two-wire communication line of a two-wire measuring instrument which consists of a transmitter and a receiver connected to each other through the two-wire communication line and transmits a process value detected by the transmitter to the receiver as an analog signal, the communication apparatus being adapted to communicate with the transmitter, comprising a switching device for separating a closed loop constituted by the transmitter and the receiver into a first loop including the transmitter and a second loop including the receiver, a power source for supplying power to the transmitter in the first loop, and dummy output means for outputting a dummy signal to the receiver in the second loop.

3 Claims, 1 Drawing Sheet

TWO-WIRE COMMUNICATION APPARATUS

BACKGROUND OF THE INVENTION

1. Field of the Invention

The present invention relates to communication apparatus. More specifically the present invention is directed to a two-wire communication apparatus.

SUMMARY OF THE INVENTION

An object of the present invention is to provide an improved two-wire communication apparatus.

In accomplishing this and other objects, there has been provided, in accordance with the present invention, a communication apparatus inserted in parallel in a two-wire communication line of a two-wire measuring instrument which consists of a transmitter and a receiver connected to each other through the two-wire communication line and transmits a process value detected by the transmitter to the receiver as an analog signal, the communication apparatus being adapted to communicate with the transmitter, comprising a switching device for separating a closed loop constituted by the transmitter and the receiver into a first loop including the transmitter and a second loop including the receiver, a power source for supplying power to the transmitter in the first loop, and dummy output means for outputting a dummy signal to the receiver in the second loop.

BRIEF DESCRIPTION OF THE DRAWINGS

A better understanding of the present invention may be had when the following description is read in connection with the accompanying drawings, in which.

DESCRIPTION OF THE PREFERRED EMBODIMENT

Figure 2:
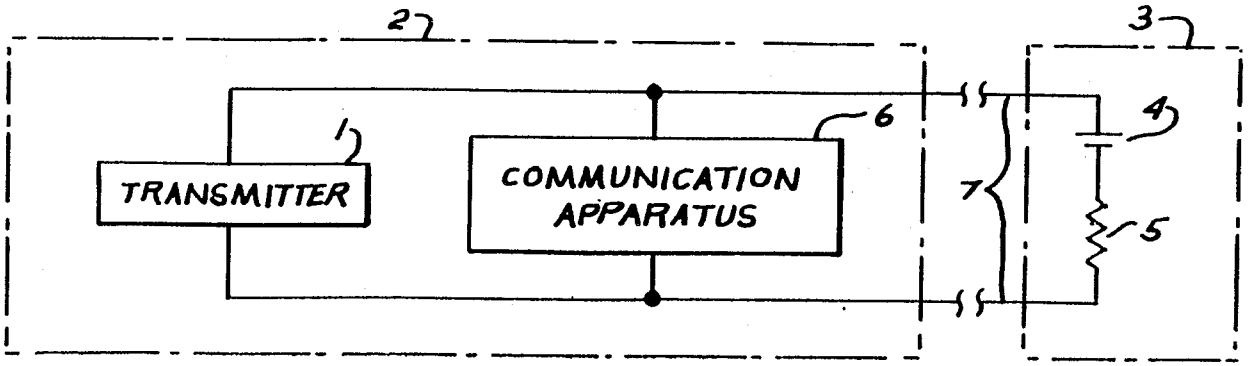
FIG. 2 is a circuit diagram showing a prior art arrangement of a two-wire measuring instrument and a connection state of a communication apparatus.

FIG. 2 is a circuit diagram of a prior art two-wire measuring instrument comprising transmitter 1 installed at a measurement site 2, a power source 4 arranged in a measuring chamber 3, and a reception resistor 5 serving as a signal receiver. The transmitter 1 serves to detect a process variable and to produce a representative output signal, e.g., a differential voltage, and to transmit the detected data. An analog current signal of 4 to 20 mA is conventionally transmitted from the transmitter 1 along a two-wire communication line 7 to the measuring chamber 3 and is received by the reception resistor 5 as a voltage across the two resistor terminals.

Generally, a communication apparatus 6 which can be additionally connected in parallel across the two-wire line 7 is of a portable type. For example, the communication apparatus 6 is inserted in parallel in a two-wire loop in the site 2, as shown in FIG. 2 and communicates with the transmitter 1. In this case, changes in parameters or adjustments for the transmitter 1 are mainly communicated, Such a communication apparatus is disclosed in U.S. Pat. No. 4,520,488 entitled, "Communication System and Method". However, in such a conventional communication apparatus, a voltage across the two terminals of the receiver 5 is changed by a current flowing in a digital manner through the communication apparatus 6. This change in voltage is detected by the receiver 5 to perform communication. Therefore, while the communication apparatus 6 is operated, changes in voltage appear in the reception resistor 5 serving as the receiver.

The communication apparatus according to the present invention, on the other hand, comprises switching means for separating a closed loop constituted by a transmitter and a receiver into a first loop including the transmitter and a second loop including the receiver, a power source for supplying power to the transmitter in the first loop, and dummy output means for outputting a dummy signal to the receiver in the second loop. After the loop is separated by the switching means, communication with the transmitter can be performed through the first loop. In addition, a communication signal during the communication does not influence the receiver.

Figure 1:
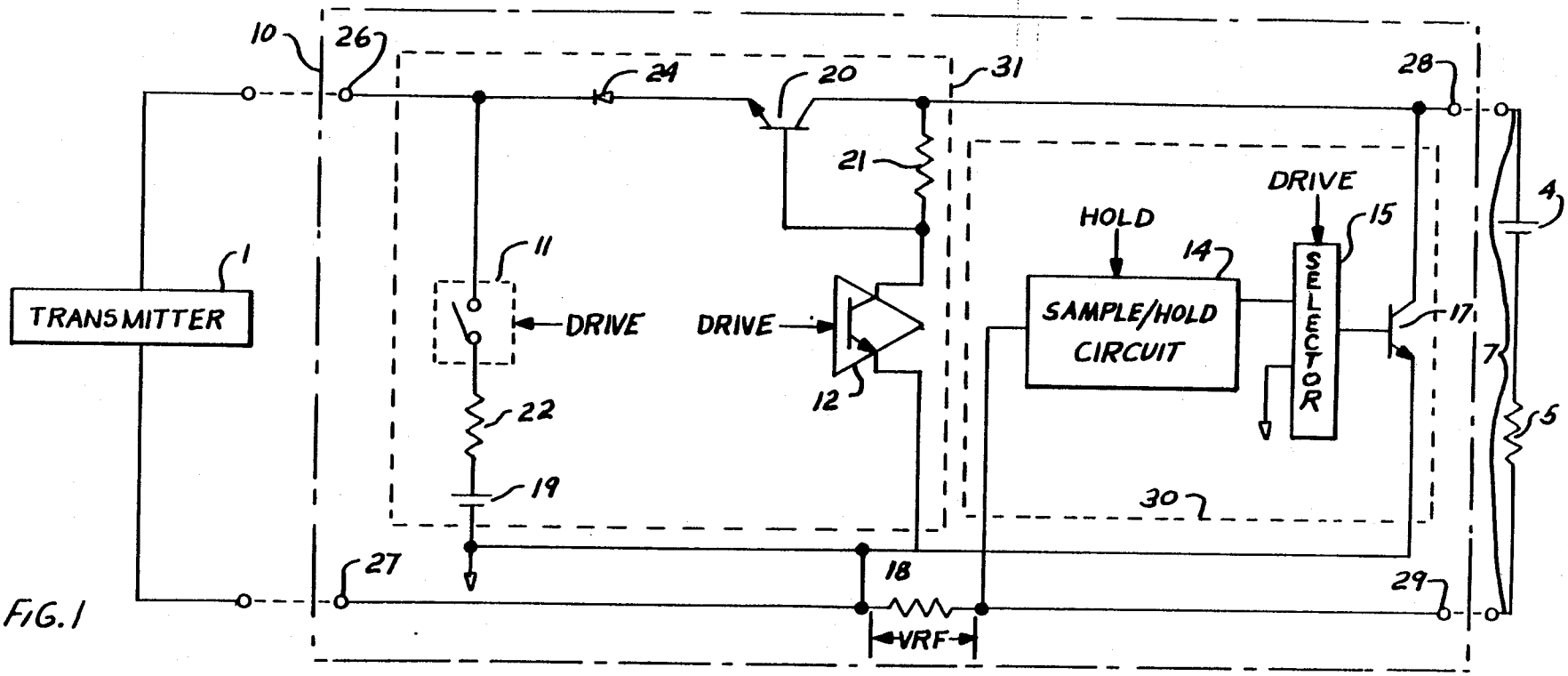
FIG. 1 is a circuit diagram of an embodiment of an example of the present invention.

The present invention will now be described in detail with reference to an embodiment illustrated in FIG. 1 which is a circuit diagram having the same reference numerals in FIG. 1 to denote the same parts shown in FIG. 2 and described above. A communication apparatus 10 includes a dummy output means 30 and a switching means 31. The switching means 31 separates a loop constituted by a transmitter 1 and a reception resistor 5 serving as a receiver, as needed, thereby forming different loops on a transmitter 1 side and a reception resistor 5 side, respectively.

The switching means 31 includes a transistor 20 serving as a switch and a switch 11. When the switch 11 is turned "off" and the transistor 20 is turned "on", a loop serving as a two-wire measuring instrument is formed. Conversely, when the switch 11 is turned "on" and the transistor 20 is turned "off", the loop serving as the two-wire measuring instrument is interrupted. At this time, a loop of switch 11, transmitter 1, power source 19, resistor 22 and switch 11 arranged in the order named is formed o the transmitter 1 side, and a loop of reception resistor 5, loop power source 4, transistor 17, resistor 18 and reception resistor 5 arranged in the order named is formed on the reception resistor 5 side. Reference numeral 12 denotes a switch for driving the switching transistor 20.

The dummy output means 30 samples and stores a current value of the loop as the two-wire measuring instrument immediately before it is separated by the switching means 31, and outputs the corresponding current to the loop on the reception resistor 5 side as a dummy current value. The dummy output means 30 includes a sample/hold circuit 14 and a selector 15. When communication between the transmitter 10 and the receiver 1 is not performed, the dummy output means 30 and switching means 31 are in a non-operative state. More specifically, first and second switch signals respectively denoted by (DRIVE) and (HOLD) in FIG. 1 are in an OFF state.

When the switch signal DRIVE is in the OFF state, the following three states are present, i.e., ① The switch 11 is turned "off" (open). ② An input B is selected as an input to the selector 15 and its output is set in a zero level. Therefore, the transistor 17 is turned "off". ③ The transistor 12 is turned "off". That is, the transistor 20 is turned "on".

When the switch signal HOLD is in the OFF state, the sample/hold circuit 14 is set in a sampling state.

When communication is to be performed from such a non-communication state, the switch signals HOLD and DRIVE are sequentially turned "on". Upon turning "on" the switch signal HOLD, a potential difference VRF corresponding to a loop current value at this time is held as an output from the sample/hold circuit 14.

Then, the switch signal DRIVE is turned "on" to drive the switch 11, the selector 15, and the transistor 12. When the transistor 12 is turned "on", the transistor 20 is turned "off", thereby cutting off power supply from the loop power source 4 to the transmitter 1. When the selector 15 is operated, an input A (a hold value of the sample/hold circuit 14) is selected and a current value corresponding to the hold value flows into the reception resistor 5 through the transistor 17. More specifically, the current corresponding to the hold value flows through the reception resistor 5 side loop of reception resistor 5, loop power source 4, transistor 17, resistor 18 and reception resistor 5, and a dummy signal is applied to the reception resistor 5. When the switch 11 is turned "on", the transmitter 1 side loop of switch 11, diode 24, power source 19, resistor 22 and switch 11 is formed, and power is supplied from the power source 19 to the transmitter 1.

In this state, when communication with the transmitter 1 is performed by supplying a digital signal between terminals 26 and 27, a communication signal does not influence the reception resistor 5. That is, a value of a current flowing through the reception resistor 5 during a communication can be held at a state immediately before the communication is started The arrangements of the switching means 31 and the dummy output means 30 are not limited to the embodiment of the present invention. For example, the switching transistor 20 in the switching means 31 can be replaced with a relay switch or the like.

As has been described above, according to the communication apparatus of the present invention, after the loop serving as the two-wire measuring instrument is separated by the switching means into the transmitter and received side loops, communication with the transmitter is performed in the transmitter side loop while supplying a dummy output to the receiver in the receiver side loop. Therefore, a received current of the receiver is not influenced during the communication, and the received current is always kept constant during the communication Accordingly, it may be seen that there has been provided, in accordance with the present invention, an improved two-wire communication apparatus.

The embodiments of the present invention in which an exclusive property or privilege is claimed are defined as follows:

1. A communication apparatus inserted in parallel in a two-wire communication line of two-wire measuring instrument, which consists of a transmitter and a receiver connected to each other through said two-wire communication line and transmits a processed amount detected by said transmitter to said receiver as an analog signal, said communication apparatus being adapted to communicate with said transmitter, comprising switching means for separating a closed loop constituted by said transmitter and said receiver into a first loop including said transmitter and a second loop including said receiver, a power source for supplying power to said transmitter in said first loop, and a dummy output means for outputting a dummy signal to said receiver in said second loop.

2. A communication apparatus as set forth in claim 1 wherein said switching means includes a pair of switching devices for establishing said first and second loops.

3. A communication apparatus as set forth in claim 1 wherein said output means includes a sample-and-hold means.

* * * * *